US011768451B1

(12) United States Patent
Nishimura

(10) Patent No.: US 11,768,451 B1
(45) Date of Patent: Sep. 26, 2023

(54) BELT DRIVE DEVICE

(71) Applicant: TOSHIBA TEC KABUSHIKI KAISHA, Tokyo (JP)

(72) Inventor: Yosuke Nishimura, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/941,162

(22) Filed: Sep. 9, 2022

(51) Int. Cl.

| | |
|---|---|
| ***G03G 15/16*** | (2006.01) |
| ***G03G 15/08*** | (2006.01) |
| ***G03G 21/00*** | (2006.01) |
| ***B65H 5/02*** | (2006.01) |
| ***G03G 15/00*** | (2006.01) |

(52) U.S. Cl.
CPC ..... *G03G 15/1615* (2013.01); *B65H 5/021* (2013.01); *G03G 15/0806* (2013.01); *G03G 15/161* (2013.01); *G03G 15/162* (2013.01); *G03G 15/1605* (2013.01); *G03G 15/5008* (2013.01); *G03G 21/0011* (2013.01); *B65H 2404/25* (2013.01); *G03G 2215/00156* (2013.01); *G03G 2215/1623* (2013.01)

(58) Field of Classification Search
CPC ..... G03G 15/0806; G03G 15/1605; G03G 15/161; G03G 15/1615; G03G 15/162; G03G 15/5008; G03G 2215/00156; G03G 2215/1623; G03G 21/0011; B65H 5/021; B65H 2404/25
See application file for complete search history.

(56) References Cited

U.S. PATENT DOCUMENTS 6,009,290 A * 12/1999 Mochida ..... G03G 15/1605 399/162
6,141,522 A * 10/2000 Tsuruoka ..... G03G 15/161 474/166
2014/0241762 A1* 8/2014 Kaneko ..... G03G 15/162 399/302

FOREIGN PATENT DOCUMENTS

| | | |
|---|---|---|
| JP | 2000-321954 | 11/2000 |
| JP | 2016-167091 | 9/2016 |
| JP | 2019-175185 | 10/2019 |

* cited by examiner

*Primary Examiner* — Joseph S Wong
(74) *Attorney, Agent, or Firm* — AMIN, TUROCY & WATSON, LLP

(57) ABSTRACT

A belt drive device includes a drive unit, a detection unit, a blade, and a control unit. The drive unit rotates an endless belt. The detection unit detects a position of a connection portion in which both ends of a reinforcing tape, which is provided on an outer surface of an edge of the belt in a width direction orthogonal to a rotation direction of the belt, in a longitudinal direction along the edge of the belt are overlapped and connected. The blade comes into contact with an outer surface of the belt and an outer surface of the reinforcing tape and is provided to extend in the width direction. The control unit controls driving of the drive unit based on a detection result obtained by the detection unit such that when the drive unit rotates the belt by a constant length in a reverse direction from one end of the reinforcing tape overlapped inside toward the other end of the reinforcing tape overlapped outside at the connection portion from a state in which the belt is stopped, the drive unit rotates the belt in a forward direction to a rotation position where the other end of the reinforcing tape does not come into contact with the blade by a reverse rotation and stops the belt before the belt is reversely rotated.

20 Claims, 6 Drawing Sheets

BELT DRIVE DEVICE

FIELD

Embodiments described herein relate to a belt drive device that drives a transfer belt of an image forming apparatus, for example.

BACKGROUND

As an example of an image forming apparatus installed in a workplace or the like, a digital multifunction peripheral is provided. The digital multifunction peripheral functions as a scanner, a printer, a facsimile, a copier, and the like.

The digital multifunction peripheral includes an image forming unit that forms an image on a sheet. The image forming unit includes: a plurality of photosensitive drums that form toner images of respective colors based on color-separated image data; a transfer belt that overlaps and transfers the toner images of the respective colors formed on surfaces of the plurality of photosensitive drums; a transfer device that transfers, to a sheet, color images overlapped on the transfer belt; a fixing device that fixing, to the sheet, the color images transferred to the sheet; and the like.

The transfer belt comes into contact with the surfaces of the plurality of photosensitive drums and travels in an endless manner. A constant tension is applied to the transfer belt and friction occurs between the transfer belt and each of the photosensitive drums. Therefore, the transfer belt is likely to crack at an edge along a traveling direction due to aging deterioration. When the edge cracks, the transfer belt needs to be replaced.

DETAILED DESCRIPTION

In general, according to one embodiment, a belt drive device includes a drive unit, a detection unit, a blade, and a control unit. The drive unit is configured to rotate an endless belt. The detection unit is configured to detect a position of a connection portion in which both ends of a reinforcing tape, which is provided on an outer surface of an edge of the belt in a width direction orthogonal to a rotation direction of the belt, in a longitudinal direction along the edge of the belt are overlapped and connected. The blade is configured to come into contact with an outer surface of the belt and an outer surface of the reinforcing tape and provided to extend in the width direction. The control unit is configured to control driving of the drive unit based on a detection result obtained by the detection unit such that when the drive unit rotates the belt by a constant length in a reverse direction from one end of the reinforcing tape overlapped inside toward another end of the reinforcing tape overlapped outside at the connection portion from a state in which the belt is stopped, the drive unit rotates the belt in a forward direction to a rotation position where the other end of the reinforcing tape does not come into contact with the blade by a reverse rotation and stops the belt before the belt is reversely rotated.

Hereinafter, an embodiment will be described with reference to the drawings.

Figure 1:
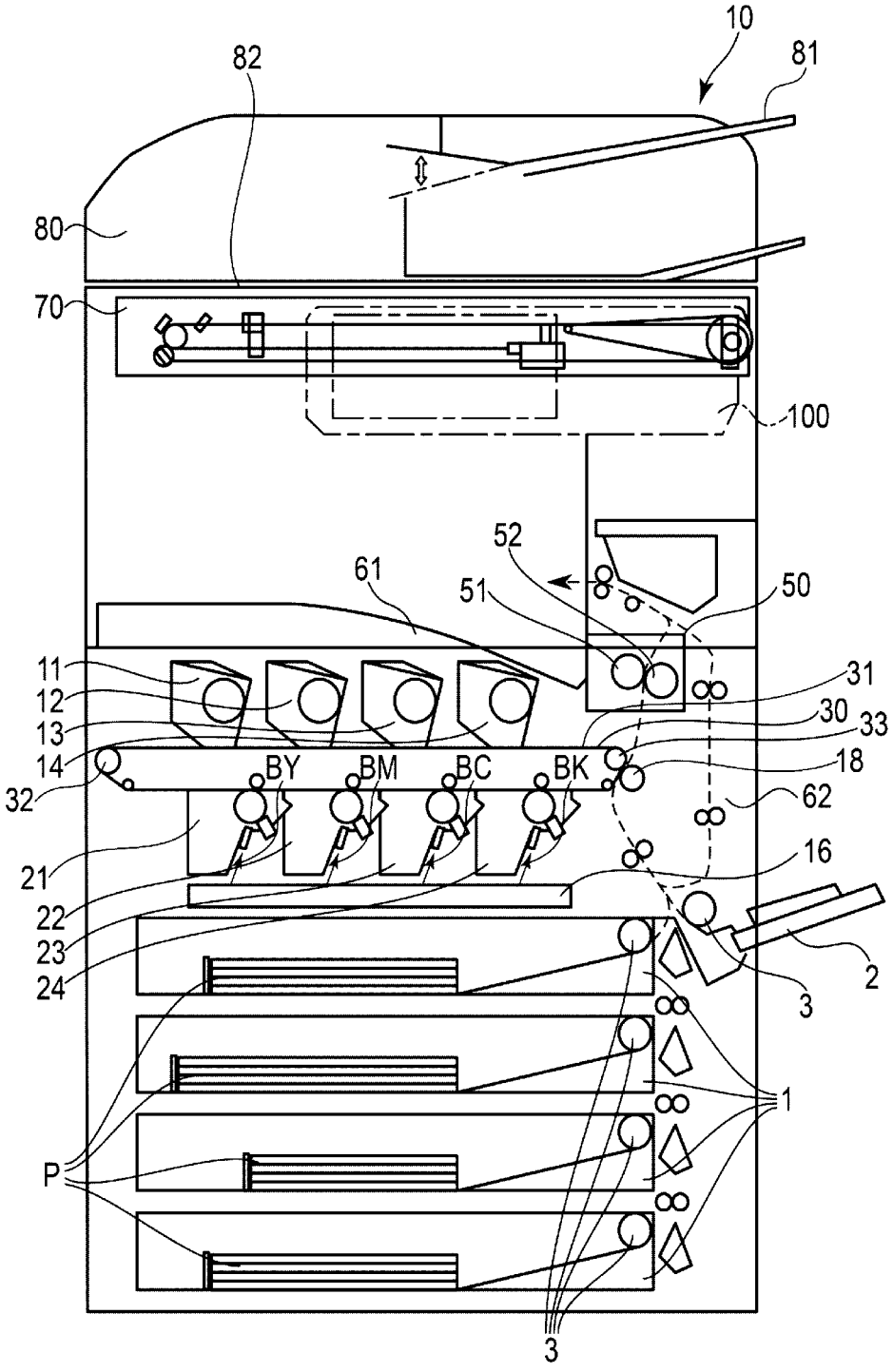
FIG. 1 is a schematic diagram illustrating a digital multifunction peripheral as an example of an image forming apparatus including a belt drive device according to an embodiment.

A digital multifunction peripheral 10 illustrated in FIG. 1 has many functions such as a printing function, a scanning function, a copying function, and a facsimile function. The printing function is a function of forming a toner image on a sheet P. The scanning function is a function of reading an image from a document. The copying function is a function of printing the image read from the document using the scanning function on the sheet P using the printing function. The facsimile function is a function of printing an image based on data received over a communication line on the sheet P using the printing function, and transmitting image data read from the document using the scanning function over the communication line.

The digital multifunction peripheral 10 includes a plurality of sheet feed cassettes 1, a manual feed tray 2, and a plurality of sheet feed rollers 3. The sheet feed cassette 1 stores a plurality of sheets P used for printing. The manual feed tray 2 is for manually feeding the plurality of sheets P in a stacked state. The sheet feed roller 3 takes out the sheets P stored in the sheet feed cassette 1 one by one, and takes out the sheets P placed on the manual feed tray 2 one by one.

The digital multifunction peripheral 10 includes a plurality of toner cartridges 11, 12, 13, and 14, a plurality of image forming units 21, 22, 23, and 24, an exposure device 16, a transfer belt unit 30, and a secondary transfer roller 18. In the digital multifunction peripheral 10, the plurality of toner cartridges 11, 12, 13, and 14 are arranged side by side in a traveling direction of a transfer belt 31 and above the transfer belt unit 30 in the drawing. In the digital multifunction peripheral 10, the plurality of image forming units 21, 22, 23, and 24 are arranged side by side in the traveling direction of the transfer belt 31 and below the transfer belt unit 30 in the drawing.

The toner cartridges 11, 12, 13, and 14 store toner of respective colors to be supplied to the image forming units 21, 22, 23, and 24. The leftmost toner cartridge 11 in FIG. 1 stores toner of a yellow color. The second toner cartridge 12 from the left stores toner of a magenta color. The third toner cartridge 13 from the left stores toner of a cyan color. The rightmost toner cartridge 14 stores toner of a black color.

The image forming units 21, 22, 23, and 24 receive supplying of the toner from the toner cartridges 11, 12, 13, and 14, respectively, and form toner images of different colors. The leftmost image forming unit 21 in FIG. 1 forms a toner image of a yellow (Y) color. The second image forming unit 22 from the left forms a toner image of a magenta (M) color. The third image forming unit 23 from the left forms a toner image of a cyan (C) color. The rightmost image forming unit 24 forms a toner image of a black (K) color.

The image forming units 21, 22, 23, and 24 have substantially the same configuration except for a difference in toner. Therefore, the image forming unit 21 that forms the toner image of a yellow color is representatively described with reference to FIG. 2, and descriptions of the image forming units 22, 23, and 24 that form toner images of other colors are omitted.

Figure 2:
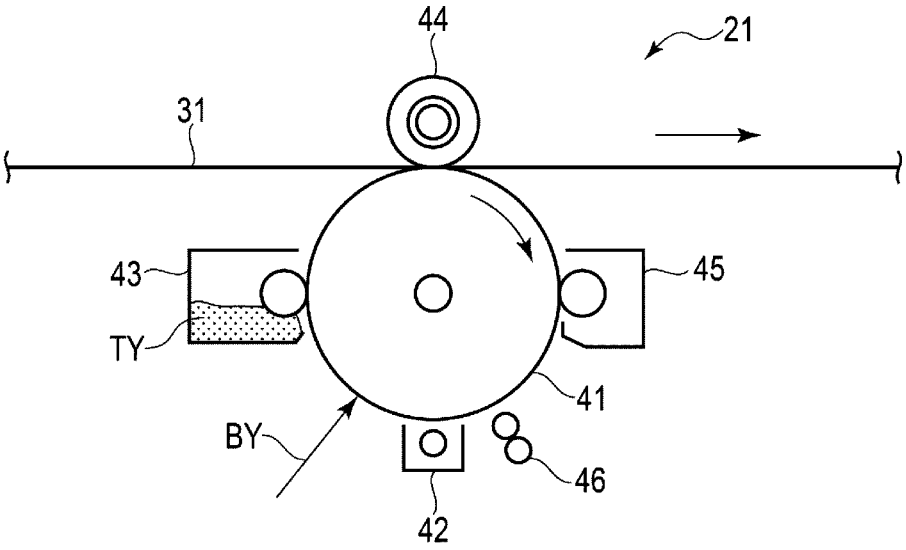
FIG. 2 is a schematic diagram illustrating an example of an image forming unit.

As illustrated in FIG. 2, the image forming unit 21 for a yellow color includes a photosensitive drum 41, a charging unit 42, a developing device 43, a primary transfer roller 44, a cleaner 45, and a charge eliminating lamp 46. In the digital multifunction peripheral 10, the image forming unit 21 for a yellow color and the image forming units 22, 23, and 24 for other colors are arranged at equal intervals along the traveling direction of the transfer belt 31.

The photosensitive drum 41 has a cylindrical surface that receives a light beam BY emitted from the exposure device 16. The light beam BY is a light beam based on image data of a yellow color obtained by color separation of image data read from a document by a scanner 70 to be described later or image data input from an external device of the digital multifunction peripheral 10. The exposure device 16 exposes and scans a surface of the photosensitive drum 41 by the light beam BY as the photosensitive drum 41 rotates, and forms an electrostatic latent image based on the image data of a yellow color on the surface of the photosensitive drum 41.

The charging unit 42 charges the surface of the photosensitive drum 41 before exposure to a predetermined potential. The developing device 43 develops the electrostatic latent image on the surface of the photosensitive drum 41 with toner TY supplied from the toner cartridge 11. The developing device 43 forms a toner image of a yellow color on the surface of the photosensitive drum 41.

The primary transfer roller 44 faces the surface of the photoconductor drum 41 with the transfer belt 31 of the transfer belt unit 30 interposed between the primary transfer roller 44 and the photosensitive drum 41. The primary transfer roller 44 generates a transfer voltage between the primary transfer roller 44 and the photosensitive drum 41. With the transfer voltage, the primary transfer roller 44 transfers (primarily transfers), to a surface of the transfer belt 31 that comes into contact with the photosensitive drum 41, the toner image of a yellow color formed on the surface of the photosensitive drum 41.

The cleaner 45 removes the toner TY remaining on the surface of the photosensitive drum 41. The charge eliminating lamp 46 eliminates the electric charge remaining on the surface of the photosensitive drum 41.

The exposure device 16 illustrated in FIG. 1 irradiates the surfaces of the photosensitive drums 41 of the image forming units 21, 22, 23, and 24 with light beams BY, BM, BC, and BK according to the color-separated image data of respective colors. The light beams BY, BM, BC, and BK are used for forming yellow, magenta, cyan, and black images, respectively.

The exposure device 16 controls the light beam BY according to a Y component of the image data to form an electrostatic latent image for a yellow color on the surface of the photosensitive drum 41 of the image forming unit 21. Similarly, the exposure device 16 controls the light beams BM, BC, and BK according to M, C, and K components of the image data to form electrostatic latent images for a magenta color, a cyan color, and a black color on the surfaces of the photosensitive drums 41 of the image forming units 22, 23, and 24.

The transfer belt unit 30 includes the endless transfer belt 31 and two rollers around which the transfer belt 31 is wound and stretched. These two rollers are a driven roller 32 and a drive roller 33. The transfer belt unit 30 further includes a tension roller for applying tension to the transfer belt 31. By rotating the drive roller 33, the transfer belt 31 can rotate in both forward and reverse directions. The transfer belt 31 rotates in a forward direction, which is a counterclockwise direction in FIG. 1, thereby conveying the toner images of the respective colors transferred from the image forming units 21, 22, 23, and 24 to the secondary transfer roller 18.

The secondary transfer roller 18 faces a surface of the drive roller 33 with the transfer belt 31 interposed between the secondary transfer roller 18 and the drive roller 33, and generates a transfer voltage between the secondary transfer roller 18 and the drive roller 33. With the transfer voltage, the secondary transfer roller 18 transfers (secondary transfers), to the sheet P conveyed between the transfer belt 31 and the secondary transfer roller 18, the toner images of the respective colors overlapped and transferred on the surface of the transfer belt 31.

The digital multifunction peripheral 10 further includes a fixing device 50. The fixing device 50 heats and applies pressure to the sheet P onto which the toner images of the respective colors are transferred. Accordingly, the toner images of the respective colors transferred to the sheet P are fixed to the sheet P. The fixing device 50 includes a heat roller 51 and a pressure roller 52 that face each other with a conveyance path of the sheet P interposed between the heat roller 51 and the pressure roller 52.

The heat roller 51 includes a heat source for heating the heat roller 51. The heat source is, for example, a heater. The heat roller 51 heated by the heat source heats the sheet P to a melting temperature of the toner. The pressure roller 52 applies pressure to the sheet P passing between the pressure roller 52 and the heat roller 51.

The digital multifunction peripheral 10 further includes a sheet output tray 61, a duplex unit 62, the scanner 70, a document feeder 80, and a control panel 100.

The sheet output tray 61 receives the sheet P output after the printing is completed. The duplex unit 62 brings the sheet P into a state in which a back surface of the sheet can be printed. For example, the duplex unit 62 reverses a front surface and the back surface of the sheet P by switching back the sheet P using a roller or the like, and feeds the sheet P to the image forming unit.

The scanner 70 reads an image from the document. The scanner 70 reads the image by an optical reduction method including an image pickup device such as a charge-coupled device (CCD) image sensor. Alternatively, the scanner 70 reads the image by a contact image sensor (CIS) method including an image pickup device such as a complementary metal-oxide-semiconductor (CMOS) image sensor.

The document feeder 80 is also referred to as an auto document feeder (ADF), for example. The document feeder 80 sequentially conveys the documents fed via a tray 81 through a document glass 82. The scanner 70 reads images of the documents conveyed to the document glass 82.

The control panel 100 includes buttons, a touch panel, and the like for an operator of the digital multifunction peripheral 10 to operate. A touch panel is formed by, for example, stacking a display such as a liquid crystal display or an organic EL display and a pointing device by touch input. Therefore, the buttons and the touch panel function as an input device that receives operations by the operator of the digital multifunction peripheral 10. The display of the touch panel functions as a display device that notifies the operator of the digital multifunction peripheral 10 of various types of information.

Figure 3:
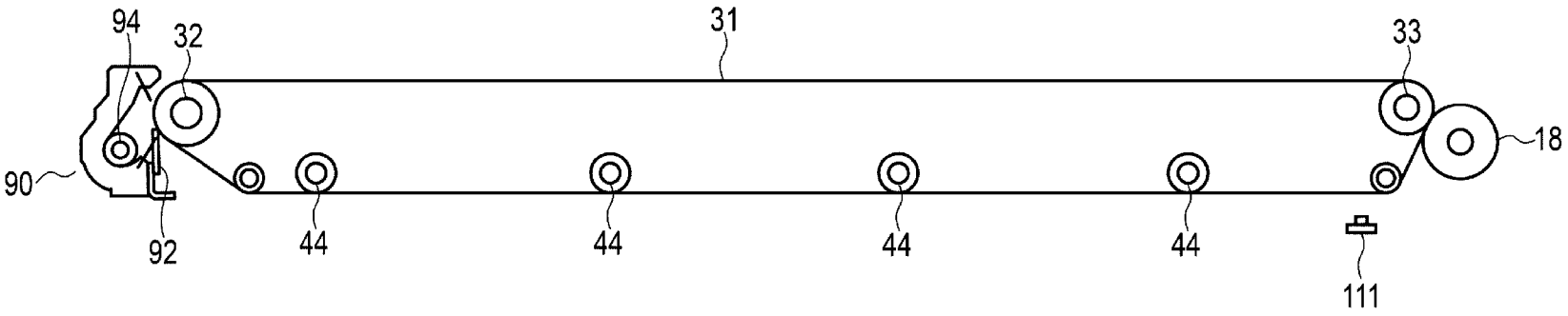
FIG. 3 is a schematic diagram illustrating a transfer belt and peripheral members thereof.
Figure 4:
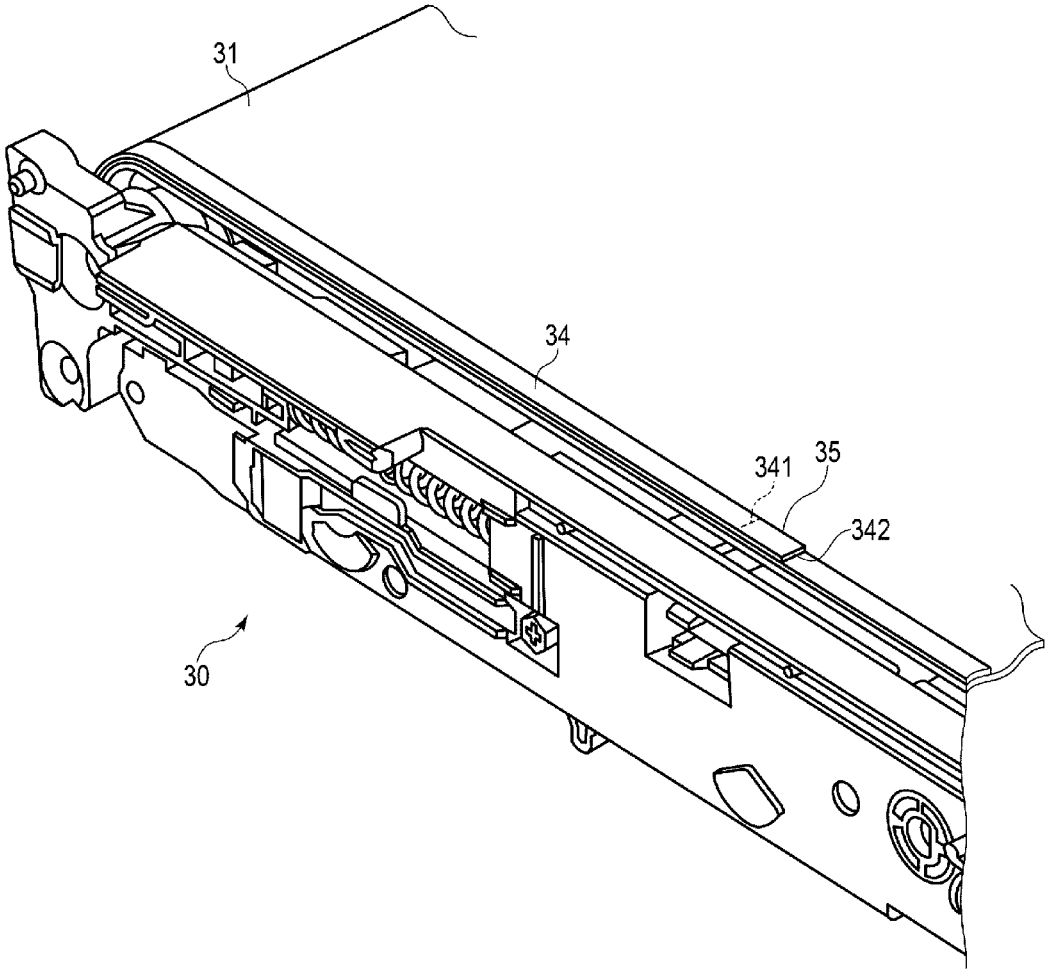
FIG. 4 is a partially enlarged perspective view illustrating a main part of the transfer belt.

As illustrated in FIG. 3, the transfer belt unit 30 includes the drive roller 33, the driven roller 32, the transfer belt 31, and a belt cleaner 90. The transfer belt 31 is wound around the drive roller 33 and the driven roller 32 and can travel in an endless manner. As illustrated in FIG. 4, the transfer belt 31 includes reinforcing tapes 34 on outer surfaces of both edges of the transfer belt 31 in a width direction orthogonal to a longitudinal direction. In FIG. 4, the reinforcing tape 34 of the transfer belt 31 on a front side in the width direction is illustrated, and the reinforcing tape 34 of the transfer belt 31 on a rear side is not illustrated.

The transfer belt 31 is made of, for example, polyimide. The transfer belt 31 receives the tension by exertion of the tension roller and comes into contact with the surfaces of the photosensitive drums 41 of the respective colors. Therefore, the transfer belt 31 is likely to crack at both edges in the width direction orthogonal to the longitudinal direction due to aging deterioration. Therefore, the transfer belt 31 includes, for example, reinforcing tapes 34 made of plastic on the outer surfaces of both edges of the transfer belt 31 in the width direction.

The reinforcing tape 34 is slightly longer than the transfer belt 31 and is narrower than the transfer belt 31. A width of the reinforcing tape 34 is, for example, about 10 mm to 15 mm. The reinforcing tape 34 is attached to an outer surface of the transfer belt 31 with an adhesive or a double-sided tape. An edge of the reinforcing tape 34 on outside in the width direction is substantially flush with the edge of the transfer belt 31 in the width direction over entire length of the reinforcing tape 34. Both ends of the reinforcing tape 34 in the longitudinal direction are vertically overlapped and connected by, for example, welding. Therefore, a connection portion 35 of the reinforcing tape 34 has a level difference corresponding to a thickness of the reinforcing tape 34. The outer surface of the transfer belt 31 and an outer surface of the reinforcing tape 34 other than the connection portion 35 also have a level difference corresponding to the thickness of the reinforcing tape 34.

More specifically, the reinforcing tape 34 has, at the connection portion 35, one end 341 that is contact with the outer surface of the transfer belt 31 and is disposed inside, and the other end 342 that is overlapped outside of the one end 341. The connection portion 35 is a portion in which the one end 341 and the other end 342 of the reinforcing tape 34 are overlapped and connected. The reinforcing tape 34 is attached to the outer surface of the transfer belt 31 in an orientation in which when the transfer belt 31 is rotated in the forward direction, the other end 342 of the reinforcing tape 34 that is overlapped outside at the connection portion 35 is not caught by a cleaning blade 92. That is, the reinforcing tape 34 is attached to the outer surface of the transfer belt 31 in an orientation in which the one end 341 of the reinforcing tape 34 is disposed on a downstream side with respect to the other end 342 of the reinforcing tape 34 in the counterclockwise direction, which is the forward direction in which the transfer belt 31 travels during image formation.

The connection portions 35 of the two reinforcing tapes 34 provided at both edges in the width direction of the transfer belt 31 are located face to each other in the width direction. However, the two reinforcing tapes 34 do not necessarily need to be attached to the transfer belt 31 such that the connection portions 35 face each other in the width direction, and the connection portions 35 may be slightly offset in the traveling direction of the transfer belt 31.

The belt cleaner 90 includes the cleaning blade 92 and a waste toner auger 94. The belt cleaner 90 includes the cleaning blade 92 in a state in which a leading edge of the cleaning blade 92 comes into contact with the outer surface of the transfer belt 31 at a position where the belt cleaner 90 faces a surface of the driven roller 32. The cleaning blade 92 has the leading edge parallel to an axis of the driven roller 32. The leading edge of the cleaning blade 92 comes into contact with the outer surface of the transfer belt 31 and the outer surface of the reinforcing tape 34. That is, the cleaning blade 92 has a width equivalent to a width of the transfer belt 31.

The cleaning blade 92 comes into contact with the outer surface of the transfer belt 31 at an acute angle. That is, the belt cleaner 90 includes the cleaning blade 92 in such a posture that an angle between the cleaning blade 92 and the transfer belt 31 and an angle between the cleaning blade 92 and the reinforcing tape 34, on a downstream side in the forward direction from a contact position where the cleaning blade 92 comes into contact with the outer surface of the transfer belt 31 and the outer surface of the reinforcing tape 34, are acute angles. Therefore, when the transfer belt 31 and the reinforcing tape 34 rotate in the forward direction, the cleaning blade 92 scrapes off toner adhering to the outer surface of the transfer belt 31 and the outer surface of the reinforcing tape 34.

The waste toner auger 94 conveys, toward a toner discharge port of the belt cleaner 90, the toner scraped off from the outer surface of the transfer belt 31 and the outer surface of the reinforcing tape 34 by the cleaning blade 92. The belt cleaner 90 further includes a mylar or the like for preventing toner leakage.

Figure 5:
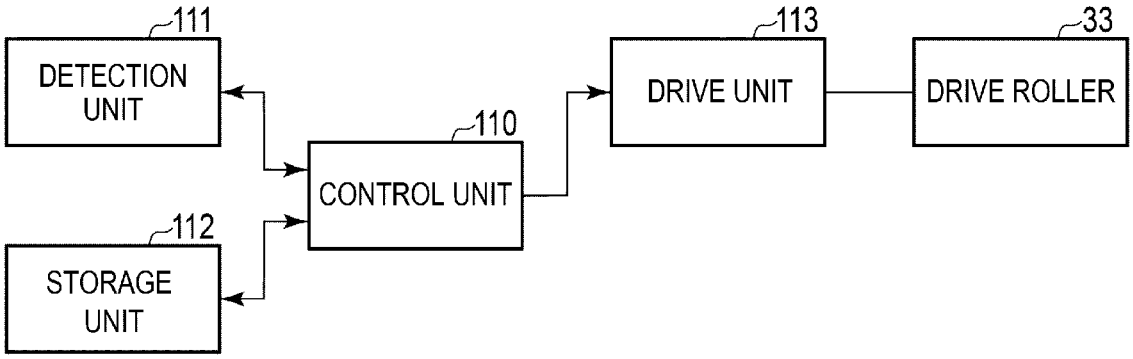
FIG. 5 is a block diagram illustrating a drive system of the transfer belt.

Next, a control system of the belt drive device that drives the transfer belt 31 described above will be described with reference to FIG. 5.

The belt drive device includes a control unit 110, a detection unit 111, a storage unit 112, and a drive unit 113. The detection unit 111 detects the connection portion 35 of the reinforcing tape 34. For example, the detection unit 111 detects a position of the connection portion 35 by detecting a mark provided at one position on the outer surface of the reinforcing tape 34. In this case, the mark may be a welding mark formed by welding of the connection portion 35, or may be the other end 342 of the reinforcing tape 34 that is overlapped outside at the connection portion 35. Alternatively, the mark may be provided on the outer surface of the transfer belt 31, and may have any shape. The detection unit 111 can also serve as, for example, a reflective sensor that detects a wedge mark for determining a positional deviation and a magnification deviation of the toner images of the respective colors transferred to the outer surface of the transfer belt 31.

The storage unit 112 stores, for example, information about a stop position of the connection portion 35 that is moved until a rotation of the transfer belt 31 is stopped after the connection portion 35 of the reinforcing tape 34 is detected by the detection unit 111. The storage unit 112 stores information about the position of the connection portion 35 before a reverse rotation in which the other end 342 of the reinforcing tape 34 reaches the contact position of the cleaning blade 92 by reversely rotating the transfer belt 31 by a constant length to be described later. Here, the connection portion 35 can be replaced with the other end 342 of the reinforcing tape 34.

The drive unit 113 biases the drive roller 33 around which the transfer belt 31 is wound to rotate the transfer belt 31 in both forward and reverse directions, and stops the rotation of the transfer belt 31. The drive unit 113 may be, for example, a motor that rotates the photosensitive drums 41 of the image forming units 21, 22, 23, and 24 of the respective colors.

The control unit 110 controls driving of the drive unit 113 based on a detection result of the detection unit 111. For example, the control unit 110 rotates the transfer belt 31 in the reverse direction by the constant length when residual toner, paper dust, and the like adhering to the cleaning blade 92 of the belt cleaner 90 are removed. At this time, the constant length for reversely rotating the transfer belt 31 is, for example, about 10 mm to 20 mm. When the transfer belt 31 is reversely rotated in a state in which the leading edge of the cleaning blade 92 comes into contact with the outer surface of the transfer belt 31, the toner and the paper dust jammed between the leading edge of the cleaning blade 92 and the outer surface of the transfer belt 31 are moved and separated. The toner and the paper dust separated from the cleaning blade 92 in this manner are conveyed and discharged by the waste toner auger 94.

When the transfer belt 31 forwardly rotates from a stopped state such as during the image formation, even if the connection portion 35 of the reinforcing tape 34 passes through the contact position of the cleaning blade 92, the other end 342 of the reinforcing tape 34 overlapped outside at the connection portion 35 is not caught by the leading edge of the cleaning blade 92. That is, in this case, since the leading edge of the cleaning blade 92 comes into sliding contact with the outer surface of the reinforcing tape 34 in a direction from one end of the reinforcing tape 34 to the other end, no force is exerted to turn up the other end of the reinforcing tape 34 when the leading edge of the cleaning blade 92 is beyond the other end of the reinforcing tape 34. Therefore, when the transfer belt 31 is simply forwardly rotated, the control unit 110 can control the driving of the drive unit 113 regardless of the detection result of the detection unit 111.

On the other hand, when the toner and the paper dust adhering to the cleaning blade 92 are removed by reversely rotating the transfer belt 31, there is a possibility that when the connection portion 35 of the reinforcing tape 34 passes through the contact position of the cleaning blade 92, the leading edge of the cleaning blade 92 is caught by the other end 342 of the reinforcing tape 34 and the other end 342 of the reinforcing tape 34 is turned up. When the reinforcing tape 34 is peeled off, the transfer belt 31 at that portion is damaged and deteriorates. Therefore, in the present embodiment, the belt drive device is controlled according to a flowchart of FIG. 6 so as not to cause such a problem.

Figure 6:
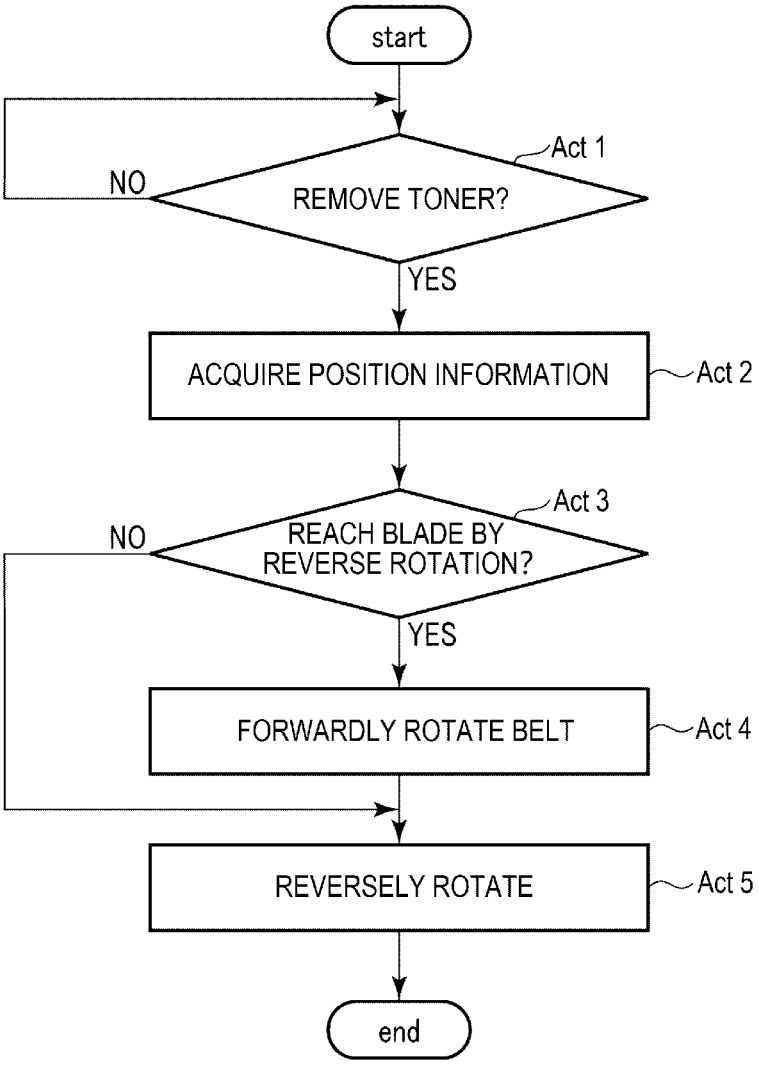
FIG. 6 is a flowchart illustrating operations performed by a control unit in FIG. 5.

In the digital multifunction peripheral 10, when a mode for removing the toner and the paper dust adhering to the cleaning blade 92 is selected, the control unit 110 of the belt drive device determines YES in Act 1 in FIG. 6 and proceeds to Act 2. Thereafter, in Act 2, the control unit 110 reads information about the position of the connection portion 35 of the reinforcing tape 34 from the storage unit 112. The information about the position of the connection portion 35 includes information about a reference position (hereinafter, referred to as reference position information) which is a threshold value of control measured in advance, and information about a current position (hereinafter, referred to as current position information) which is newly stored in the storage unit 112 every time the transfer belt 31 is stopped.

The reference position information read from the storage unit 112 in Act 2 is information about the position of the connection portion 35 before the transfer belt 31 is reversely rotated when the connection portion 35 of the reinforcing tape 34 just reaches the contact position of the cleaning blade 92 during reversely rotating the stopped transfer belt 31 by the constant length. The reference position information is determined by the constant length by which the transfer belt 31 is reversely rotated. The current position information read from the storage unit 112 in Act 2 is position information indicating an actual position of the connection portion 35 at a current time point, and changes depending on a stop position of the transfer belt 31.

When the position information is acquired in Act 2, the control unit 110 proceeds to Act 3. In Act 3, the control unit 110 determines whether the connection portion 35 of the reinforcing tape 34 reaches the contact position of the cleaning blade 92 if the transfer belt 31 in the stopped state is reversely rotated by a predetermined constant length. At this time, the control unit 110 compares the two pieces of position information acquired in Act 2, and determines whether the connection unit 35 reaches the contact position of the cleaning blade 92 due to the reverse rotation of the transfer belt 31 with the constant length.

In Act 3, if the control unit 110 determines that the actual current position of the connection unit 35 is on an upstream side in the forward direction with respect to the reference position which is the threshold value and on a downstream side in the forward direction with respect to the contact position of the cleaning blade 92, the control unit 110 determines that the connection unit 35 reaches the contact position of the cleaning blade 92 due to the reverse rotation of the transfer belt 31 with the constant length, and proceeds to Act 4. In Act 4, the control unit 110 forwardly rotates the transfer belt 31 to a position where the actual connection portion 35 is disposed on the downstream side in the forward direction with respect to the reference position.

On the other hand, in Act 3, if the control unit 110 determines that the actual current position of the connection unit 35 is on the downstream side in the forward direction with respect to the reference position and on the upstream side in the forward direction with respect to the contact position of the cleaning blade 92, the control unit 110 proceeds to Act 5. In Act 5, the control unit 110 reversely rotates the transfer belt 31 by the constant length without forwardly rotating the transfer belt 31.

As described above, by controlling the driving of the transfer belt 31, the other end 342 of the reinforcing tape 34 can be prevented from being turned up by the cleaning blade 92. Therefore, according to the present embodiment, the aging deterioration of the transfer belt 31 can be prevented and cracks can be made less likely to occur at the edges of the transfer belt 31 in the width direction. Therefore, according to the present embodiment, a service life of the transfer belt 31 can be extended.

While certain embodiment have been described, this embodiment has been presented by way of example only, and is not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A belt drive device, comprising:

a drive component configured to rotate an endless belt;

a detector configured to detect a position of a connection portion in which both ends of a reinforcing tape, provided on an outer surface of an edge of the belt in a width direction orthogonal to a rotation direction of the belt, in a longitudinal direction along the edge of the belt are overlapped and connected;

a blade configured to contact an outer surface of the belt and an outer surface of the reinforcing tape, extendable in the width direction; and a controller configured to control driving of the drive component based on a detection result obtained by the detector such that when the drive component rotates the belt by a constant length in a reverse direction from one end of the reinforcing tape overlapped inside toward another end of the reinforcing tape overlapped outside at the connection portion from a state in which the belt is stopped, the drive component rotates the belt in a forward direction to a rotation position where the other end of the reinforcing tape does not contact the blade by a reverse rotation and stops the belt before the belt is reversely rotated.

2. The belt drive device according to claim 1, wherein if the controller determines, based on the detection result obtained by the detector, that the other end of the reinforcing tape does not reach a contact position of the blade even if the belt is reversely rotated by the constant length from the state in which the belt is stopped, the belt is reversely rotated by the constant length without rotating in the forward direction.

3. The belt drive device according to claim 1, wherein if the belt is rotated in the forward direction from the state in which the belt is stopped, the controller controls the driving of the drive component regardless of the detection result obtained by the detector.

4. The belt drive device according to claim 1, further comprising:

a storage component configured to store the position of the connection portion before the reverse rotation where the other end of the reinforcing tape reaches a contact position of the blade by reversely rotating the belt by the constant length.

5. The belt drive device according to claim 4, wherein the controller compares the position of the connection portion stored in the storage component with an actual position of the connection portion detected by the detector, and controls, based on a comparison result, the driving of the drive component.

6. The belt drive device according to claim 5, wherein when the actual position of the connection portion detected by the detector is on an upstream side in the forward direction with respect to the position of the connection portion stored in the storage component and on a downstream side in the forward direction with respect to the contact position of the blade, the controller controls the driving of the drive component so as to rotate the belt in the forward direction until the other end of the reinforcing tape moves to the downstream side in the forward direction with respect to the position of the connection portion stored in the storage component.

7. The belt drive device according to claim 5, wherein when the actual position of the connection portion detected by the detector is on a downstream side in the forward direction with respect to the position of the connection portion stored in the storage component and on an upstream side in the forward direction with respect to the contact position of the blade, the controller controls the driving of the drive component so as to reversely rotate the belt without rotating the belt in the forward direction.

8. The belt drive device according to claim 1, wherein the blade is attached in such a posture that an angle between the blade and the belt and the reinforcing tape in the forward direction from a contact position where the blade contacts the outer surface of the belt and the outer surface of the reinforcing tape is an acute angle.

9. The belt drive device according to claim 1, wherein the reinforcing tapes are provided on outer surfaces of both edges of the belt in the width direction.

10. The belt drive device according to claim 9, wherein the connection portions of two reinforcing tapes face each other in the width direction.

11. A method for operating a belt drive device, comprising:

rotating an endless belt;

detecting a position of a connection portion in which both ends of a reinforcing tape, provided on an outer surface of an edge of the belt in a width direction orthogonal to a rotation direction of the belt, in a longitudinal direction along the edge of the belt are overlapped and connected;

contacting an outer surface of the belt and an outer surface of the reinforcing tape with a blade, extendable in the width direction; and controlling rotating the belt based on a detection result obtained such that when rotating the belt by a constant length in a reverse direction from one end of the reinforcing tape overlapped inside toward another end of the reinforcing tape overlapped outside at the connection portion from a state in which the belt is stopped, rotating the belt in a forward direction to a rotation position where the other end of the reinforcing tape does not contact the blade by a reverse rotation and stopping the belt before the belt is reversely rotated.

12. The method according to claim 11, further comprising:

if, based on the detection result obtained, the other end of the reinforcing tape does not reach a contact position of the blade even if the belt is reversely rotated by the constant length from the state in which the belt is stopped, rotating the belt reversely by the constant length without rotating in the forward direction.

13. The method according to claim 11, further comprising:

if the belt is rotated in the forward direction from the state in which the belt is stopped, controlling the rotation regardless of the detection result obtained.

14. The method according to claim 11, further comprising:

storing the position of the connection portion before the reverse rotation where the other end of the reinforcing tape reaches a contact position of the blade by reversely rotating the belt by the constant length.

15. The method according to claim 14, further comprising:

comparing the position of the connection portion stored with an actual position of the connection portion detected, and controlling, based on a comparison result, the rotating of the belt.

16. The method according to claim 15, further comprising:

when the actual position of the connection portion detected is on an upstream side in the forward direction with respect to the position of the connection portion stored and on a downstream side in the forward direction with respect to the contact position of the blade, controlling rotating the belt so as to rotate the belt in the forward direction until the other end of the reinforcing tape moves to the downstream side in the forward direction with respect to the position of the connection portion stored.

17. The method according to claim 15, further comprising:

when the actual position of the connection portion detected is on a downstream side in the forward direction with respect to the position of the connection portion stored and on an upstream side in the forward direction with respect to the contact position of the blade, controlling rotating the belt so as to reversely rotate the belt without rotating the belt in the forward direction.

18. An image forming apparatus, comprising:

a plurality of photosensitive drums configured to form toner images of respective colors based on color-separated image data;

a transfer belt that overlaps and transfers the toner images of the respective colors formed on surfaces of the plurality of photosensitive drums;

a transfer device that transfers, to a sheet, color images overlapped on the transfer belt;

a fixing device configured to fix, to the sheet, the color images transferred to the sheet;

a belt drive device, comprising:

a drive component configured to rotate the transfer belt;

a detector configured to detect a position of a connection portion in which both ends of a reinforcing tape, provided on an outer surface of an edge of the belt in a width direction orthogonal to a rotation direction of the belt, in a longitudinal direction along the edge of the belt are overlapped and connected;

a blade configured to contact an outer surface of the belt and an outer surface of the reinforcing tape, extendable in the width direction; and a controller configured to control driving of the drive component based on a detection result obtained by the detector such that when the drive component rotates the belt by a constant length in a reverse direction from one end of the reinforcing tape overlapped inside toward another end of the reinforcing tape overlapped outside at the connection portion from a state in which the belt is stopped, the drive component rotates the belt in a forward direction to a rotation position where the other end of the reinforcing tape does not contact the blade by a reverse rotation and stops the belt before the belt is reversely rotated.

19. The image forming apparatus according to claim 18, wherein the blade is attached in such a posture that an angle between the blade and the belt and the reinforcing tape in the forward direction from a contact position where the blade contacts the outer surface of the belt and the outer surface of the reinforcing tape is an acute angle.

20. The image forming apparatus according to claim 18, wherein the reinforcing tapes are provided on outer surfaces of both edges of the belt in the width direction, and the connection portions of two reinforcing tapes face each other in the width direction.

* * * * *